United States Patent [19]

Kawakatsu et al.

[11] Patent Number: 4,524,410

[45] Date of Patent: Jun. 18, 1985

[54] INCANDESCENT LAMP WITH FILM OF ALTERNATELY STACKED LAYERS

[75] Inventors: Akira Kawakatsu; Fumio Yamamoto, both of Yokohama, Japan

[73] Assignee: Tokyo Shibaura Denki Kabushiki Kaisha, Kawasaki, Japan

[21] Appl. No.: 535,162

[22] Filed: Sep. 23, 1983

[30] Foreign Application Priority Data

Sep. 28, 1982 [JP] Japan ..... 57-167603

[51] Int. Cl.[3] ..... F21M 3/14

[52] U.S. Cl. ..... 362/255; 362/293; 362/297; 313/112

[58] Field of Search ..... 313/112; 362/2, 255, 362/267, 293, 297

[56] References Cited

U.S. PATENT DOCUMENTS 3,909,649 9/1975 Arsena ..... 313/112 X
4,366,407 12/1982 Walsh ..... 362/2 X

FOREIGN PATENT DOCUMENTS

21269/77 12/1977 Australia .
34090/78 3/1978 Australia .
42858/78 12/1978 Australia .
653323 5/1951 United Kingdom .
797886 7/1958 United Kingdom .
822757 10/1959 United Kingdom .
863351 3/1961 United Kingdom .
923787 4/1963 United Kingdom .
966344 8/1964 United Kingdom .
1210757 10/1970 United Kingdom .
1571194 7/1980 United Kingdom .
2043997A 10/1980 United Kingdom .
1582685 1/1981 United Kingdom .
1602771 11/1981 United Kingdom .

OTHER PUBLICATIONS

Schroeder, *Oxide Layers Deposited From Organic Solutions,* Phys. of Thin Film 5, p. 87, (1969).

Kern et al, *Titanium Dioxide Antireflection Coating For Silicon Solar Cells* by Spray Deposition, RCA Rev., 41, p. 133, (1980).

*Primary Examiner*—Peter A. Nelson

*Attorney, Agent, or Firm*—Cushman, Darby and Cushman

[57] ABSTRACT

An incandescent lamp has a bulb with a built-in filament therein, and an infrared ray reflection film formed on one or both of the outer and inner surfaces of the bulb and containing a non-crystalline metal oxide. The infrared ray reflection film is excellent in transmittance of visible rays and in reflectance of infrared rays and does not cause separation.

4 Claims, 3 Drawing Figures

INCANDESCENT LAMP WITH FILM OF ALTERNATELY STACKED LAYERS

BACKGROUND OF THE INVENTION

The present invention relates to an incandescent lamp in which a transparent metal oxide film formed on the outer surface of a bulb has improved optical characteristics and does not separate from the bulb surface.

An incandescent lamp is known in which a transparent metal oxide film is formed on the outer surface of the bulb for bulb protection and infrared ray reflection. In consideration of uniformity of the film, productivity and cost of the lamps, such a metal oxide film is generally formed by a method in which an organic metal compound is applied on the outer surface of a bulb and is baked at a high temperature for decomposing the compound and converting the film into a thin metal oxide film.

When a lamp is turned on/off a number of times, separation of the metal oxide film tends to occur. Film separation is particularly notable in the case of a multilayered film such as an infrared ray reflection film.

SUMMARY OF THE INVENTION

It is an object of the present invention to provide an incandescent lamp having a transparent metal oxide film, which film has improved optical characteristics and an excellent adhesion strength and may not be separated.

According to the present invention, there is provided an incandescent lamp comprising a glass bulb with a built-in filament therein, and a transparent film consisting of a material containing a non-crystalline metal oxide and formed on at least one surface of said bulb. The transparent film preferably contains about 50% or more of non-crystalline titanium dioxide. Said transparent film may have a structure wherein a metal oxide layer having a high reflectivity and a metal oxide layer having a low reflectivity are alternately stacked.

More preferably, the transparent film comprises a first layer containing about 50% or more of non-crystalline titanium dioxide, a second layer of non-crystalline silica formed on said first layer, and a third layer formed on said second layer and containing about 50% or more of non-crystalline titanium dioxide. Titanium dioxide of the first and third layers has a high reflectivity, and silica of the second layer has a low reflectivity.

DETAILED DESCRIPTION OF THE PREFERRED EMBODIMENT

Details of the present invention will now be described with reference to the embodiment shown in the accompanying drawings.

Figure 1:
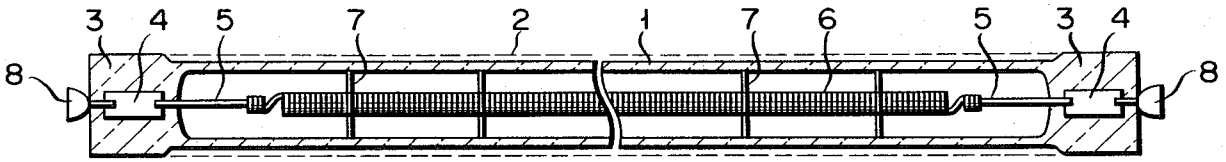
FIG. 1 is a sectional view of an incandescent lamp according to an embodiment of the present invention.
Figure 2:
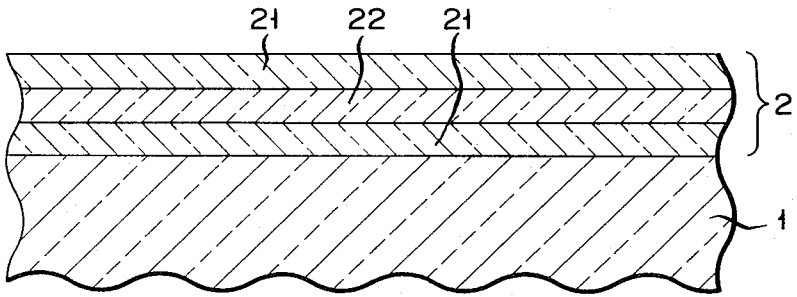
FIG. 2 is an enlarged sectional view of an infrared ray reflection film of the embodiment shown in FIG. 1.

FIG. 1 shows an example of a halogen lamp to which the present invention may be applied. Referring to FIG. 1, a tubular bulb 1 consists of quartz glass. A metal oxide film 2 as an infrared ray reflection film is formed on the outer surface of the bulb 1. Sealing portions 3 seal the two ends of the bulb 1. Molybdenum lead-in plates 4 are embedded in the respective sealing portions 3. Lead-in wires 5 are connected to the respective lead-in plates 4 and extend inside the bulb 1. A tungsten filament 6 is connected between the lead-in wires 5. Anchors 7 support the filament 6 inside the bulb 1. Bases 8 are connected to the respective lead-in plates 4. A given halogen is sealed in the bulb 1 together with an inert gas such as argon. As shown in FIG. 2, the infrared ray reflection film 2 consists of a titanium dioxide ($TiO_2$) layer 21, a silica ($SiO_2$) layer 22 and another titanium dioxide ($TiO_2$) layer 21 which are formed on the outer surface of the bulb 1 in the order named. The layers 21 and 22 contain non-crystalline $TiO_2$ and $SiO_2$, respectively.

The respective layers 21 and 22 of the infrared ray reflection film 2 have high mechanical strength and separation between these layers and between the film 2 and the glass bulb 1 may not easily occur. The film 1 also has an excellent transmittance within the visible region.

The method for forming the infrared ray reflection film 2 will now be described. First, a titanium compound containing tetraisopropyltitanate as a main component is dissolved in an organic solvent containing an acetic ester as a main component to provide a solution having a titanium content of 2 to 10% by weight and a viscosity of about 1.0 cP. A halogen lamp cleaned with ethyl alcohol is dipped in the solution up to its base portion. The lamp is taken out from the solution into an atmosphere kept at a constant temperature and humidity at a rate of 30 cm/min. Then the lamp is baked under predetermined conditions to convert the applied titanium compound into titanium dioxide to form a titanium dioxide layer 21.

A silicon compound containing ethyl silicate as a main component is dissolved in an organic solvent containing an acetic ester as a main component to provide a solution having a silicon content of 2 to 10% by weight and a viscosity of about 1.0 cP. The halogen lamp having the titanium dioxide film 21 formed thereon is dipped in the resultant solution. The lamp is pulled in a similar manner to that described above and at a rate of 35 cm/min. The lamp is baked in the air at 500° C. for 30 minutes to form a silica layer 22. Thereafter, another titanium dioxide layer 21 is formed on the silica layer 22 in the same manner as that of the first layer 21.

Lamps having different multilayered films were prepared by changing the compositions of the titanium and silicon compound solutions, the baking conditions and the like. The optical characteristics of the resultant films were tested. The obtained results revealed that the characteristics of the multilayered film are largely dependent upon the crystallographic properties of the titanium dioxide films 21.

When a titanium dioxide film is heat-treated at a temperature of 500° C. or lower, no peak is observed in X-ray diffractiometry of the film. Thus, the titanium dioxide film is seen to be substantially non-crystalline. Crystalline titanium dioxide films of $TiO_2$ in anatase and rutile forms may be formed by changing the compositions of the solutions, the baking atmospheres, and the baking temperatures.

The reflectivity of titanium dioxide non-crystalline in infrared region does not deviate much from that of crystalline titanium dioxide, i.e., anatase and rutile. A non-crystalline titanium dioxide film has a very high transmittance in the visible region and has an excellent adhesion strength and mechanical strength; it is suitable as an infrared ray reflection film. As a result of various experiments conducted, rutile and anatase prepared from a titanium compound solution were found to have a granular structure and be easy to separate so that they provide only a limited transparency. In contrast to this, non-crystalline titanium dioxide has a low dispersion in reflectivity from the visible region to the infrared region. Accordingly, non-crystalline titanium dioxide causes a slight decrease in transmittance due to interference in the visible region. Thus, non-crystalline titanium dioxide may be considered to have a higher transmittance within the overall visible region as compared with rutile and anatase.

Figure 3:
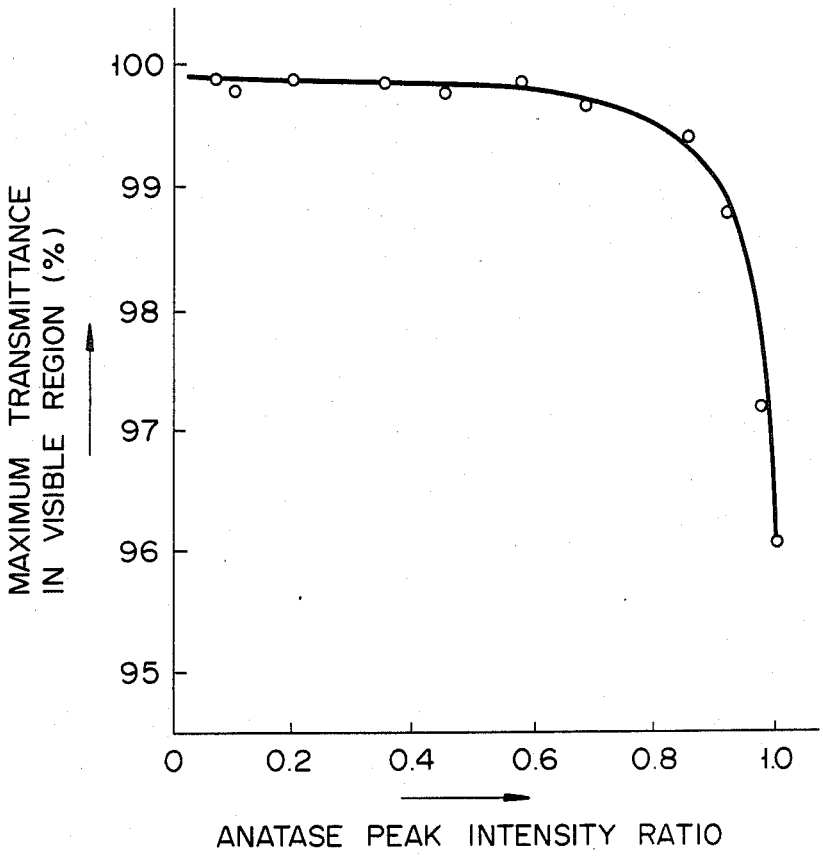
FIG. 3 is a graph showing the relationship between the ratio of the crystalline portion and non-crystalline portion of titanium dioxide and the transmittance within the visible region.

According to other various experiments conducted, the crystalline form of titanium dioxide also depends upon the baking temperature other than the compositions of the solution, the baking atmospheres and so on. When the baking time is short, the resultant titanium dioxide is non-crystalline. When the baking temperature is high, the ratio of anatase or rutile crystals increases as time elapses. After a predetermined period of time, however, the ratio of anatase or rutile crystals is saturated. FIG. 3 shows the relationship between the ratio of anatase crystals in the film (as a function of time) and the transmittance within the visible region. In FIG. 3, the anatase peak intensity ratio is plotted along the axis of abscissa and the maximum transmittance within visible region (%) is plotted along the axis of ordinate. It is seen from this graph that the transmittance within the visible region is excellent with non-crystalline titanium dioxide and is also excellent with non-crystalline titanium dioxide partially containing anatase crystals. However, when the anatase peak intensity ratio exceeds about 0.8 (corresponding to an anatase content of about 50% by weight), the transmittance within the visible region is abruptly decreased.

Infrared ray reflection films prepared under various conditions were subjected to X-ray diffractiometry to observe titanium dioxide crystals. The films were also subjected to visual observation of irregular colors and were tested for their transmittance within the visible region, reflectivity within the infrared region, adhesion strength, mechanical strength, and chemical resistance. The transmittance within the visible region changes in accordance with the thickness and reflectivity of the film. The thicknesses of the layers 21 and 22 were adjusted such that the wavelength at the maximum transmittance of the film becomes 550 nm. The mechanical strength of each film was tested by rubbing the surface of the film with a cotton cloth. A film which easily separated is indicated as x, a film which caused partial separation is indicated as Δ, and a film which caused no separation is indicated as o. The adhesion strength of each film was tested by adhesing a piece of Cellophane tape onto the film and strongly peeling the Cellophane tape piece from the film. A film which easily separated is indicated as x, a film which caused partial separation is indicated as Δ, and a film which caused no separation is indicated as o. Chemical resistance of each film was tested by immersing the film in a 10% hydrochloric solution or 10% caustic soda solution for 30 minutes and visually observing separation and dissolution of the discolored film. The obtained results are shown in the Table below.

TABLE

| $TiO_2$ form | Baking conditions | Outer appearance | Maximum transmittance in visible region | Reflectance of infrared rays | Adhesion strength | Mechanical strength | Chemical resistance |
|---|---|---|---|---|---|---|---|
| Anatase | 600° C. × 30 min (in $O_2$) | Partially separated | 96% | 16% | Δ | Δ | o |
| Rutile | 900° C. × 30 min (in $O_2$) | Partially separated | 92% | 17% | X | Δ | o |
| Non-crystalline | 500° C. × 30 min (in $O_2$) | No separation occurred | 99% | 15% | o | o | o |
| Non-crystalline (50%); Anatase (50%) | 550° C. × 30 min (in $O_2$) | No separation occurred | 99% | 16% | o | o | o |

Lamps having metal oxide films in different crystal forms prepared in the manner as described above were subjected to a life test wherein the lamps are turned on for 7 hours and turned off for 1 hour. The electrical performance of each lamp remained the same after such life test as that before the test. A lamp having a non-crystalline titanium dioxide film 21 did not cause separation of the film 21. However, lamps having films 21 of anatase and rutile crystals caused significant separation and were not satisfactory for practical use.

In all of the lamps as described above, the silica films 22 consisted of non-crystalline silica.

When metal oxides other than titanium dioxide such as zirconium dioxide ($ZrO_2$), tantalum pentoxide ($Ta_2O_5$), or cerium dioxide ($CeO_2$) or mixtures of such metal oxides are used, similar effects to those obtainable with titanium dioxide can be obtained provided such metal oxides or mixtures thereof are non-crystalline. As for a method for forming a film of such a metal oxide or a mixture of two or more of such metal oxides, the same method for forming the film in the above example may be adopted wherein an organic metal compound is applied and baked. Likewise, similar effects to those obtainable with silica may be obtained with magnesia (MgO) or alumina ($Al_2O_3$) provided the magnesia or alumina is non-crystalline.

The present invention is also applicable to a single layered film. In an infrared ray reflection film comprising a single titanium dioxide film, if the film is non-crystalline, the film is excellent in transmittance of visible rays and in reflectance of infrared rays and does not easily cause separation.

In the present invention, a transparent film is not limited to an infrared ray reflection film but may be applied to a film having a different function such as a protective film. Furthermore, irrespective of the single or multilayered structure, the film of the lamp of the present invention has excellent optical characteristics such as a transmittance within the visible region and does not easily cause separation.

According to the present invention, the metal oxide of the film may contain a small crystalline portion. A fine powder of anatase (particle size: about 0.1$\mu$) was dissolved in an organic binder and the resultant solution was applied on a quartz plate and was baked. When the resultant film was subjected to X-ray diffractiometry and electron beam diffractiometry, the film was confirmed to substantially consist of anatase crystals. The ratio of the anatase content may be approximately determined by comparing the X-ray diffractiometry peak intensity of such a film at a specific wavelength with that of a film of the same thickness prepared from the organic metal compound solution.

With a film having an anatase peak intensity ratio of 0.8, the anatase ratio at which an abrupt decrease in the transmittance in the visible region was experienced was about 50% by weight, referring to FIG. 3. From this, it is seen that the effect of the present invention can be obtained if the content of the non-crystalline portion is about 50% by weight or more.

What is claimed is:

1. An incandescent lamp comprising:

a glass bulb having a built-in filament; and a transparent film formed on at least one surface of said bulb, said transparent film having a structure containing at least three layers wherein a first layer comprising a non-crystalline metal oxide and having a first reflectivity and a second layer comprising a metal oxide and having a second reflectivity which is different from said first reflectivity are alternately stacked.

2. An incandescent lamp according to claim 1, wherein said first layer comprises not less than about 50% by weight of non-crystalline titanium dioxide.

3. An incandescent lamp according to claim 2, wherein said metal oxide forming said second layer is a non-crystalline metal oxide.

4. An incandescent lamp according to claim 3, wherein said second layer is formed of non-crystalline silicon.

* * * * *